United States Patent [19]

Lubotta et al.

[11] Patent Number: 4,668,211

[45] Date of Patent: May 26, 1987

[54] METHOD FOR PREPARING A RETURNABLE SELF-MAILER

[75] Inventors: Mark S. Lubotta; Martin Scullion, both of Westmount, Canada

[73] Assignee: FCA International Ltd., Westmount, Canada

[21] Appl. No.: 716,083

[22] Filed: Mar. 26, 1985

[51] Int. Cl.[4] ..... B31B 1/88

[52] U.S. Cl. ..... 493/188; 493/216; 493/222; 493/320; 493/919

[58] Field of Search ..... 493/187, 188, 216, 222, 493/320, 919; 270/1.1; 271/2; 101/232

[56] References Cited

U.S. PATENT DOCUMENTS

| | | | |
|---|---|---|---|
| 1,040,004 | 10/1912 | Patton | 229/73 |
| 2,147,541 | 2/1939 | Oberender | 493/188 |
| 3,020,043 | 2/1962 | Winkler et al. | 101/232 |
| 3,184,150 | 5/1965 | Hubbard | 229/73 |
| 4,454,980 | 6/1984 | Poehler | 493/216 |
| 4,487,360 | 12/1984 | Fisher et al. | 229/73 |

*Primary Examiner*—Frederick R. Schmidt
*Assistant Examiner*—Robert Showalter
*Attorney, Agent, or Firm*—Samuel Meerkreebs

[57] ABSTRACT

A mailer is prepared using laser electronic printing with variable data and digitally stored data. The sheet fed Xerox 8700 and 9700 laser printer, for instance, is limited to a width of 11" which necessitates a prefolding of the mailer blank to a length of 14", passing the prefolded blank through the laser printer with the longitudinal axis of the blank extending laterally of the path of feed, arranging the blank such that the 11" printing area will effectively cover the area of the blank to be printed using the digital data and the variable data. A computer communicates with the laser printer for providing individual variable data and form-type digitally stored data. A folder and gluer is provided for folding the blank into a suitable mailer.

5 Claims, 7 Drawing Figures

METHOD FOR PREPARING A RETURNABLE SELF-MAILER

BACKGROUND OF THE INVENTION

1. Field of the Invention

The present invention relates to a returnable self-mailer and a method and apparatus for preparing same.

2. Description of the Prior Art

With the advent of laser-electronic printing, several possibilities have been opened up in the area of pre-printed form letters or circular letters because of the versatility of laser printing. For instance, a laser printer, in response to a computer, can print a full page letter instantly. On some printers, the page can be printed on either side. The advantage of such a printer over a conventional computer printer programmed to print such individualized letters is, the quality of the print and the ability to use different type styles and graphics and, of course, the time and cost saving.

Returnable self-mailers, sometimes known as "response vehicles", are used extensively by the direct mail industry. Most self-mailers include a one-piece sheet folded and glued with appropriate serrated lines to provide a returnable envelope as well as the letter with message. Examples of such self-mailers include U.S. Pat. Nos. 1,040,004, Patton, issued Oct. 1, 1912; 3,184,150, Hubbard, issued May 18, 1965; and 4,487,360, Fisher et al, issued Dec. 11, 1984. These patents are only representative of numerous examples of various ways of folding a single sheet of paper and forming a returnable self-mailer having both message and return envelope. A self-mailer is generally manufactured on a web printing press or on a sheet fed press. The fixed intelligence is printed by the press. The individual names and addresses may be supplied at another stage by a direct mail house. A sheet or roll of paper 17½" wide is folded and glued by appropriate machinery to an envelope 8½" by 3½" including a large flap on which advertisement or other intelligence is printed.

However, laser printers which are presently available on a commercial scale, such as the Xerox 8700, have been designed to print on sheets which are 8½" by 11", that is, standard letter size paper. With a self-mailer type of blank, the printer should be able to handle up to 14".

SUMMARY OF THE INVENTION

It is an aim of the present invention to provide an improved returnable self-mailer having a construction susceptible to being printed on one side thereof, providing the necessary information both for mailing and for returning.

In one embodiment involving laser printing, it has been proposed that the blank be prefolded and glued down to a width of 14", i.e., by preforming the return envelope part, which alternatively is to be separated from the remainder of the mailer and returned. The 14" blank is then fed through the printer with the longitudinal axis of the blank extending laterally of the printer path axis, arranged such that the 11" printing area of the laser printer will merely leave a margin of 1½" on either end of the mailer. This can be varied such that, if necessary, the margins can be 2" and 1" respectively. The return address, which is usually constant, can be pre-printed on conventional equipment. On the other hand, the return address could be varied as well and printed by the electronic printing press.

The result is that the 11" area of the mailer which can be printed by the laser printer can contain the message which may vary from mailer to mailer depending on the instructions given to the laser printer by the computer. A mailer, in accordance with the present invention, would have one end folded over and glued to form the return body of an envelope, and a serrated line would run across the blank a short distance from the envelope body to leave a closing flap. The portion of the blank beyond the serrated line would bear the letter text which could be personalized to the party to whom it is directed. The name and address of the party to whom it is destined would be printed in the usual position on the letter part as well as on the upper left-hand corner of the return envelope. The individual account number could also be printed on the envelope portion in order to eliminate having to send any other material in the envelope, other than a cheque covering the amount being collected.

A window could be strategically located on the letter portion of the blank, such that when the mailer is folded closed, the name and address shows through the window. Serrated margins would be provided on either side edge of the mailer blank after printing, such as by laser printing. The mailer is glued, folded closed, and then the margins are serrated. When the mailer is to be opened, the serrated margins are removed and the letter unfolded.

In order to properly handle the mailer blank preparation, as mentioned above, on certain cut sheet type printers, the blanks must be fed as sheets as opposed to continuous fanfold. Furthermore, known top feed sheet stacking devices for printers, particularly of the Xerox type of printer, would be impractical to handle a stack of blanks which has a two ply thickness at one end (in view of the prefolded envelope part of the blank) and a single ply at the other end.

A feeding apparatus is proposed which will overcome such problems. It is proposed that a reverse feeder having a stacker means be provided which has means for removing and conveying the paper from the bottom of the stack. Means for passing the blanks over a cylinder conveyor to reverse the direction of feed is modified such that the horizontal conveyor means for advancing the blanks one by one in an overlapped manner to the laser printing means, is extended to sit in the place of the sheet stacker for the printer. The laser printing means has top sheet pickup means, and the feeder is provided with means for continuously advancing the blanks and feeding them underneath a small stack building up below the pickup means to be picked up by the pickup means of the laser printer.

BRIEF DESCRIPTION OF THE DRAWINGS

Having thus generally described the nature of the invention, reference will now be made to the accompanying drawings, showing by way of illustration, a preferred embodiment thereof, and in which.

DESCRIPTION OF THE PREFERRED EMBODIMENTS

Figure 1:
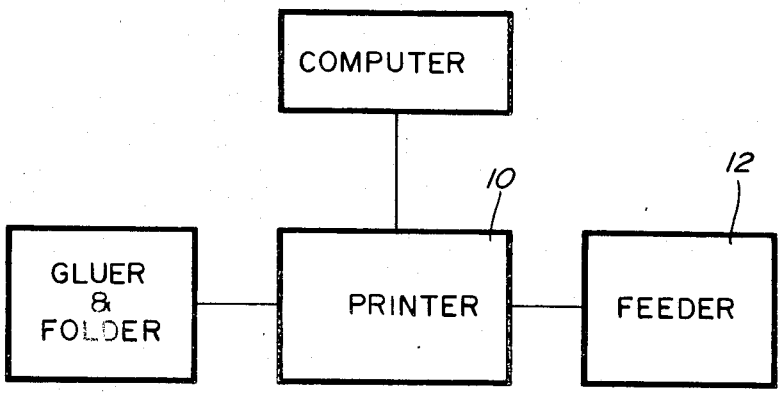
FIG. 1 is a schematic view of the arrangement required for producing a self-mailer accordance with the present invention.
Figure 3:
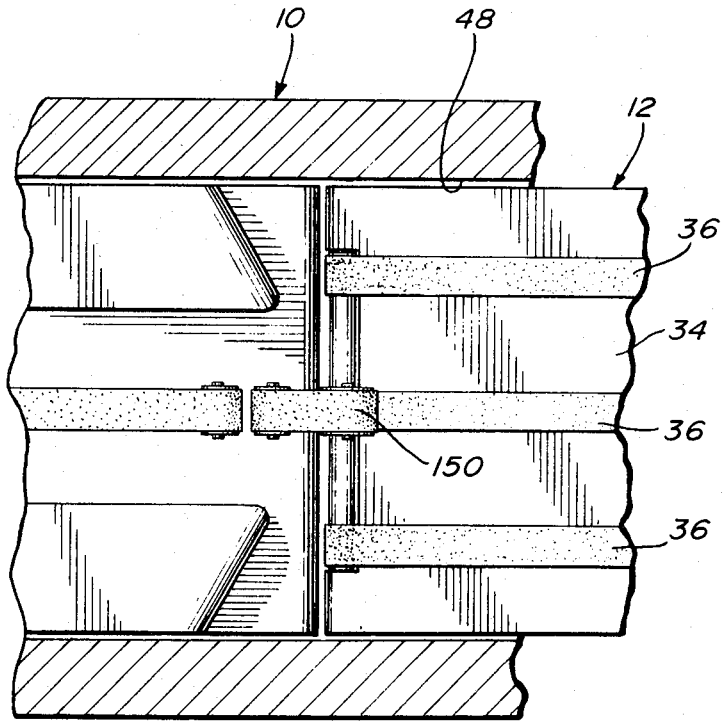
FIG. 3 is an enlarged horizontal cross-section of a detail shown in FIG. 2.

Referring now to FIG. 1 of the drawings, a typical laser printer 10 is set up in communication with a computer. A feeder 12 is connected to the printer at the in-feed end of the printer. The outfeed end of the printer may communicate with a gluer and folder.

The printer 10, in the present case, is a "Xerox 8700" presently available on the market and having a laser printer capable of high speed quality printing of original documents on one or both sides of the sheet. What would normally be a form letter can be stored digitally in the computer and called up automatically for use as required. The Xerox 8700 can merge variable data with digitally stored data. The completed forms are printed in a single pass with the variable data in perfect registration.

Figure 2:
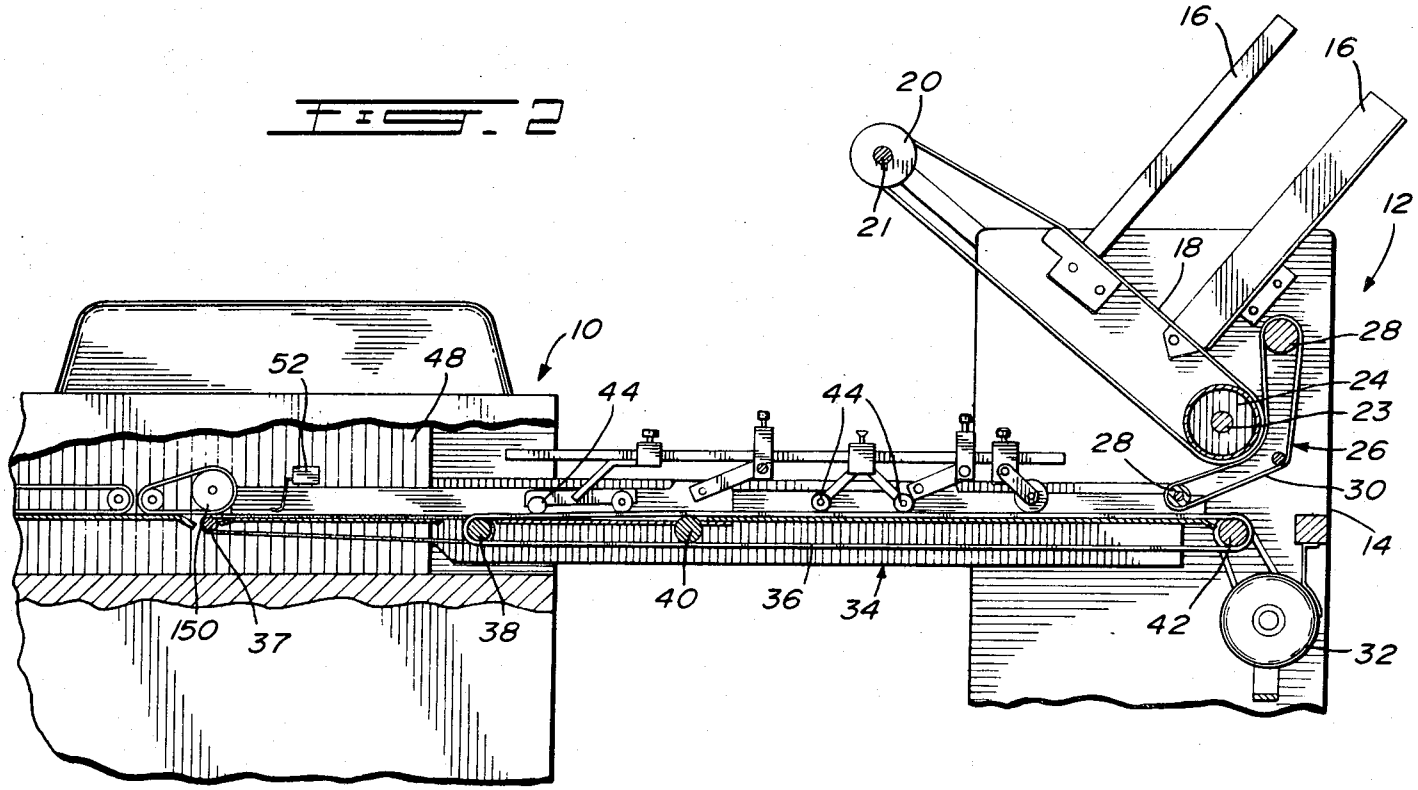
FIG. 2 is a longitudinal vertical cross-section showing a detail of the feeder and printer.

FIG. 2 shows the interface between the feeder 12 and the printer 10. The paper stacker tray normally in the paper stack bay 48 of the printer 10 is dropped to its lowest position and is rendered inoperative while the output end of the feeder 12 is inserted in the bay over the tray, as will be described later.

The feeder 12 is adapted to flex or bend the paper sheet in order to "break it" so as to make the paper easier to handle through the printer. The feeder 12, as shown, includes a stacker provided with stacking guides 16. The blanks 54 are removed from the stacker by means of conveyor straps 18 passing below the stack. The conveyor straps 18 pass over the pulleys 20 on shaft 21 and around the cylinder 24 on the shaft 23. A conveyor 26 passes the blanks 54 about the cylinder 24 in order to change the direction of feed and to "break" the blank 54. The conveyor 26 includes rollers 28 around which pass conveyor belts 30 for entraining the paper blank 54 onto the horizontal table 34.

Horizontal table 34 includes conveyor straps 36 passing over roller 42 and roller 40. A separate set of straps passes around roller 40 and roller 38 at the end of the tray or horizontal table 34. The straps advance the paper sheets or blanks on the paper table 34, while weighted or cantilevered rollers 44 press down on the blanks in order to keep the blanks 54 in order.

The end portion of the horizontal table 34 is adapted to replace the stacking tray in the stacking tray bay 48 of the printer 10. Straps 36 also pass around rollers 37 which are driven by the roller 38. A pickup device 150 is meant, as in a conventional Xerox photocopying machine, to remove the top sheet of the stack being formed while a short stack is being supplemented from the bottom by overlapping blanks advancing on the horizontal table 34 by means of the straps 36. In this manner, by synchronizing the speed and frequency of the pickup device 150 as well as the feeding of the paper blanks 54 on the horizontal table 34, an effective feed system for the printer will result.

In the past, it had been found impractical to provide a stack of blanks 54 having a panel 59 folded over at one end thereof because the blank or sheet would now have a two ply thickness at one end and a single ply thickness for the remainder of the blank. Any size of stack would provide a top blank which is not horizontal and thereby not easily removed by the pickup device 150. Instead, the horizontal table 34 of the conveyor replaces the conventional stacking system within the printer and replaces it with a much smaller stack, such as three or four blanks in a stack which are synchronizingly being advanced on the horizontal table 34 by means of the conveyor belts 36 to a position within the stacking bay of the printer where the pickup device 150 can remove blanks therefrom in preparation for printing.

Figure 4:
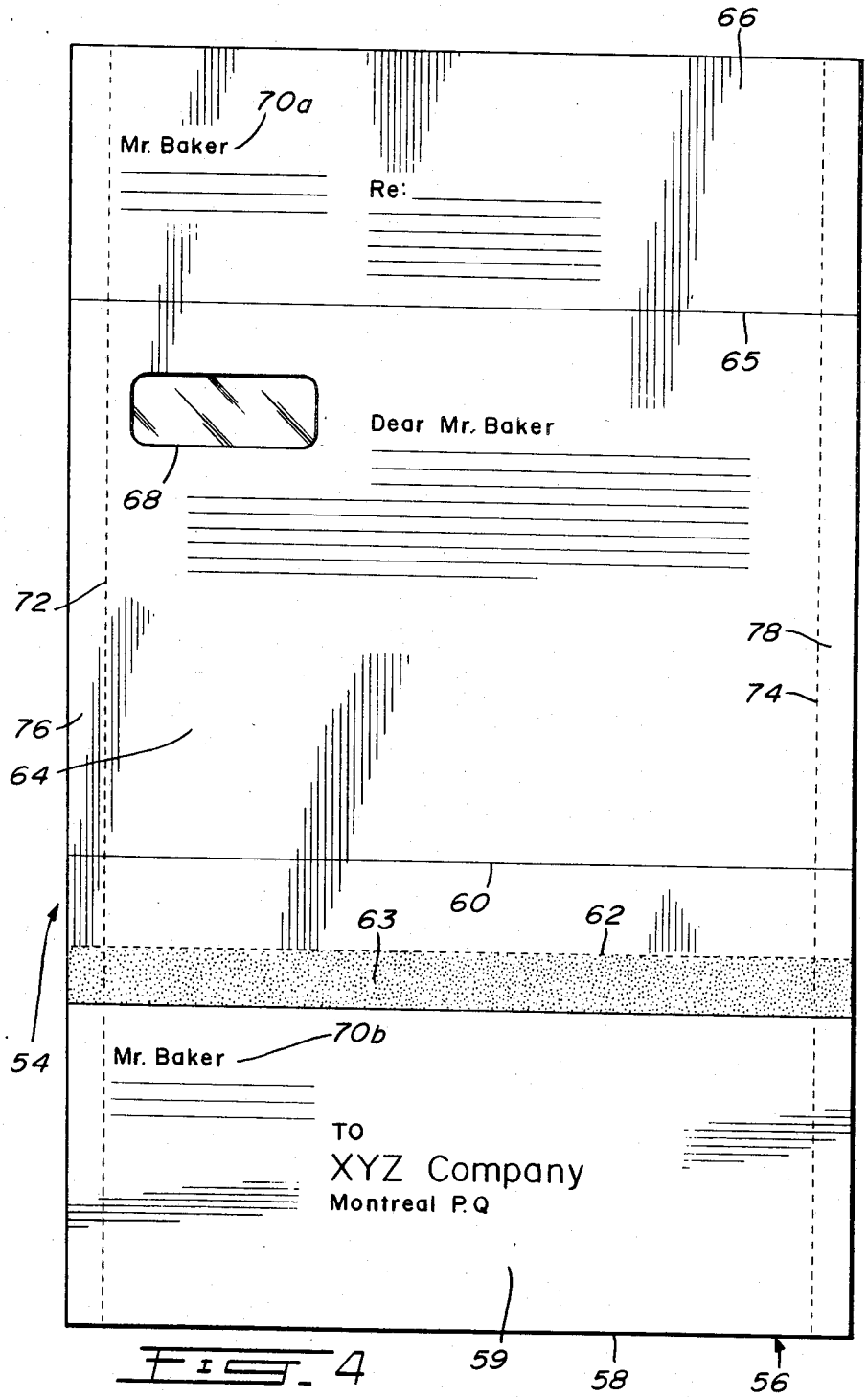
FIG. 4 is a top plan view of a mailer blank.
Figure 5A:
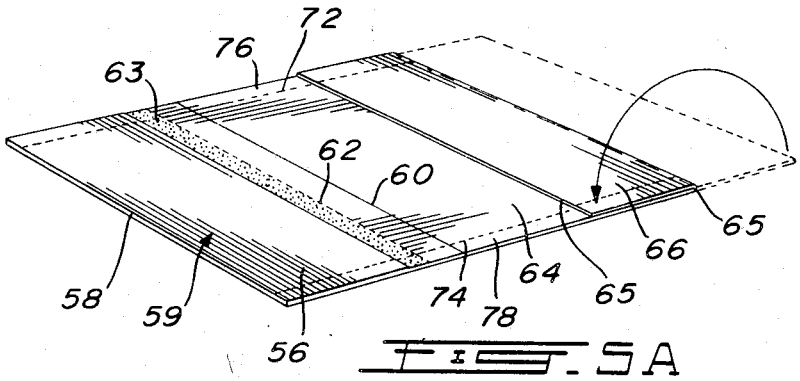
FIGS. 5A and 5B show the various steps in folding the blank to form the self-mailer.
Figure 5B:
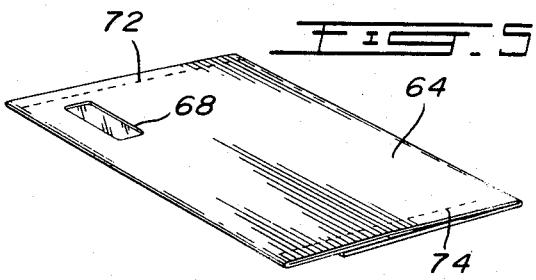
Figure 6:
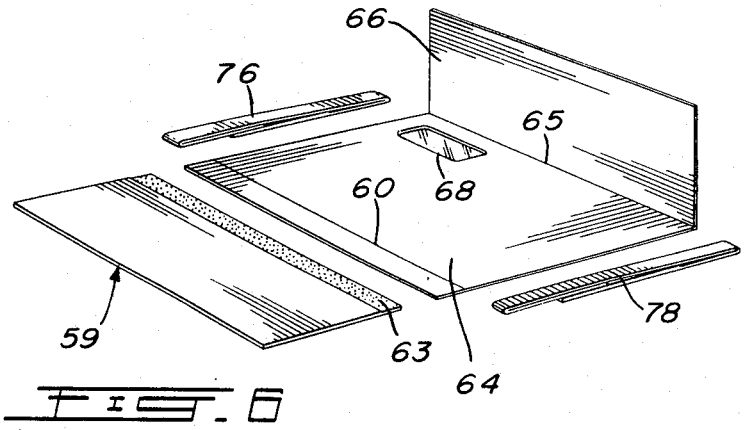
FIG. 6 is an exploded perspective view of the mailer as it may be opened.

The mailer blank 54 is illustrated in FIGS. 4 through 6. FIG. 4 illustrates the blank 54 with panel 56 folded over along fold line 58 to form an envelope 59. The end portions of the envelope are, of course, glued inwardly of the serration lines 72 and 74. A central panel 64 is provided which is delimited by the fold lines 60 and 65. Fold line 65 also defines the panel 66. The panels so described are merely for the purposes of folding over as there are really two parts to the mailer; in other words, the letter proper defined by the serration line 62 and the envelope 59 also defined by the serration line 62. The panel 64 has a window located in an area consistent with the name and address area 70 to be printed on the panel 66 so that when the panel 66 is folded over the panel 64, the name and address will appear through the window.

The envelope 59 is also provided with a glue flap 63 which extends to the serration line 62 beyond the limits of the panel 56. The edges of the mailer can be provided with tear strips 76 and 78 delimited by the serration lines 72 and 74 respectively.

As previously mentioned, the blanks 54 with the envelope 59 formed are provided in the stacker 15 and are conveyed from the bottom of the stack towards the printer 10 along the conveyor table 34 as previously described. As each blank 54 passes through the laser printer 10, the data, both digitally stored and variable, will be printed on one or both sides of the blank in an area not exceeding 11" because of the limitations of the particular printer. The blank 54, as folded and as shown in FIG. 4, measures 14" in the longitudinal direction. By advancing the blanks 54 so that the longitudinal axis extends laterally of the path of the printer, the range of the printer, that is, 11", will all but cover the page but for a remaining 3" which can be distributed on either end of the mailer.

It has been contemplated to laser print the name of the receiver of the envelope 59 which would, in any case, be variable. If, however, the name of the return address is preprinted, then at least 2½" of the envelope from its bottom margin need not be covered by the laser printing area. However, the left upper corner of the envelope identified by the numeral 70*b* can be printed on the return envelope. The name and address, therefore, to whom the mailer is addressed would be useful on the envelope as well as a reference or account number in the case of bills or collection letters. The laser printer can electronically print the name of the addressee as well as his address in the area 70*a* which will, of course, appear through the window 68 when the panel 66 is folded over the panel 64. The reference and the text can be provided in the remainder of panels 66 and 64.

Once the blank 54 has been printed, it will exit from the laser printer into a conventional folder and gluer as identified schematically in FIG. 1. The folder and gluer will effectively fold the mailer in accordance with the sequence shown in FIGS. 5A and 5B. First, the panel 66 is folded over along the fold line 65 onto the panel 64 and glued along the tear strips 76 and 78 beyond the serration lines 72 and 74. The panels 64 and 66 are then folded over the envelope 59 to form a mailer as shown in FIG. 6. When the addressee receives the mailer, he merely rips off the tear strips 76 and 78 and the panels 66 and 64 can then be easily opened. To return the envelope, it must be separated along the serration line 62, and the glue flap 63 can be folded over the envelope 59 to be returned.

We claim:

1. A method of preparing a returnable self-mailer comprising the steps of preparing a blank of paper material having a longitudinal axis and folding a first panel from one end onto the blank in the longitudinal direction to form a return envelope, advancing the so-formed blank through an electronic printing station such that the longitudinal axis of the blank extends transverse to the axis of the path of travel of the blank through the printing station wherein the maximum width of the printing area is less than the transverse extent of the blank, printing on said blank in the printing area a combination of digitally stored and variable data, subsequently folding said blank in the longitudinal direction for mailing.

2. A method as defined in claim 1, wherein a portion of the mailer is preprinted prior to being fed through the electronic printing station.

3. A method as defined in claim 1, wherein the blank is subsequently folded with a second panel starting from the end opposite the first panel being folded over a third intermediate panel and the second and third panels are then folded over the first panel.

4. A method as defined in claim 3, wherein the name and address of the addressee is electronically printed on the second panel at the electronic printing step and a window is provided on the third panel at a location such that when the second panel is folded over the third panel, the name and address of the addressee will appear through the window.

5. A method as defined in claim 4, wherein the name and address of the addressee is also printed in the upper left-hand corner of the envelope.

* * * * *